United States Patent [19]

Klingler

[11] 4,213,416

[45] Jul. 22, 1980

[54] MANIPULATING ROTARY CONTROL DEVICE

[76] Inventor: Michael R. Klingler, 1238 S. Courtland, Park Ridge, Ill. 60068

[21] Appl. No.: 11,202

[22] Filed: Feb. 12, 1979

[51] Int. Cl.[2] ..... G12B 11/02

[52] U.S. Cl. ..... 116/309; 116/200

[58] Field of Search ..... 116/309, 318, 307, 315, 116/311, 312, 314, 306, 245, 200, 323, 321; 16/118, 121; 74/553, 10.22

[56] References Cited

U.S. PATENT DOCUMENTS

| | | | |
|---|---|---|---|
| 783,210 | 2/1905 | Lewis | 74/553 |
| 1,563,635 | 12/1925 | Kasch | 74/553 |
| 1,629,891 | 5/1927 | Shaw | 74/553 |
| 2,201,540 | 5/1940 | Kauffman | 116/200 |

*Primary Examiner*—Donald Watkins
*Assistant Examiner*—Denis E. Corr
*Attorney, Agent, or Firm*—Wegner, Stellman, McCord, Wiles & Wood

[57] ABSTRACT

A manipulating rotary control device wherein a knob is connected to a dial having associated therewith a hub defining a socket for receiving the end of a control shaft, such as the valve shaft, in a domestic range or the like. The knob may be formed of a light-transmitting synthetic resin and may be hollow so as to permit desired aesthetic treatment of the interior thereof. The knob may serve as an insulating element of the assembly permitting the dial to be made of metal as well as of synthetic resin. The knob may be secured to the dial or hub by suitable means such as heat staking, etc. The hub socket may be closed so as to seal out moisture. An indicator may be associated with the knob which may be selectively movable as an incident of movement of the knob toward and from the wall from which the control shaft projects for providing an indication of the position of the control shaft. The knob may include a clear portion for viewing of the indicator in preselected disposition within the knob. A seal may be provided for sealing the interior of the knob relative to the movable indicator.

21 Claims, 13 Drawing Figures

FIG. 1
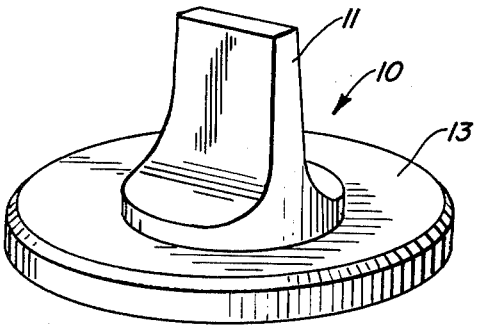
FIG. 2
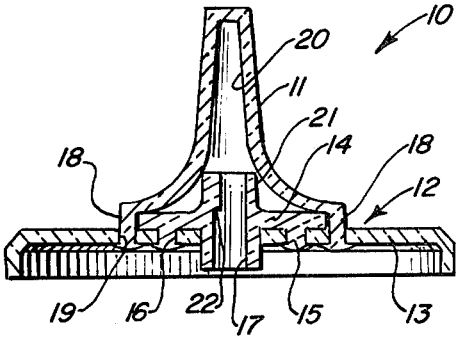
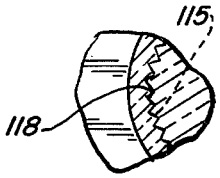
FIG. 3a
FIG. 4
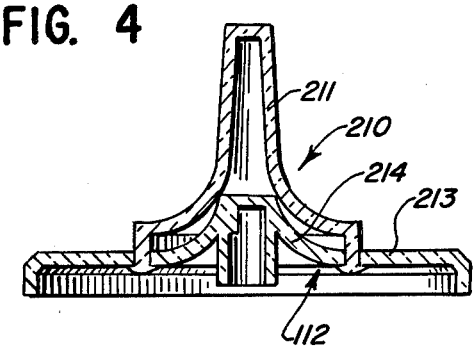
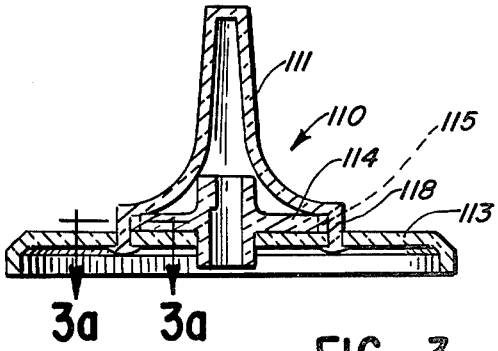
FIG. 3
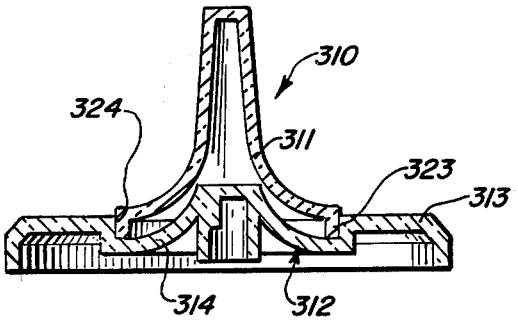
FIG. 5
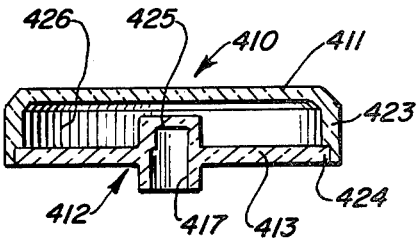
FIG. 6

FIG. 7
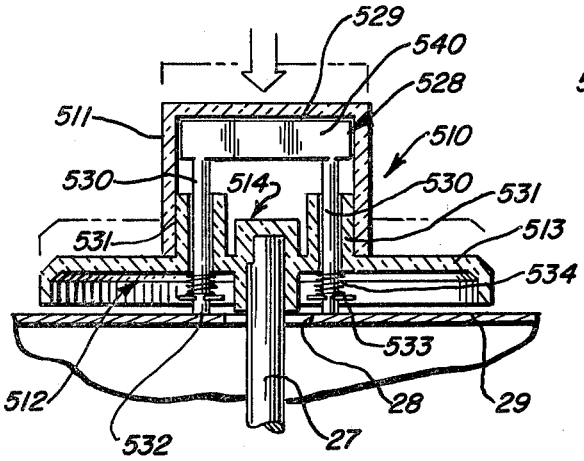
FIG. 8
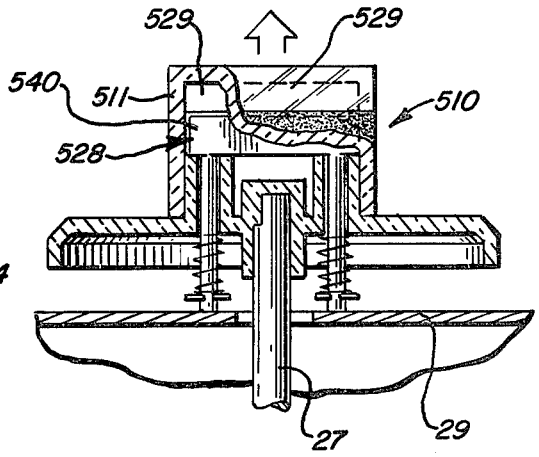
FIG. 9
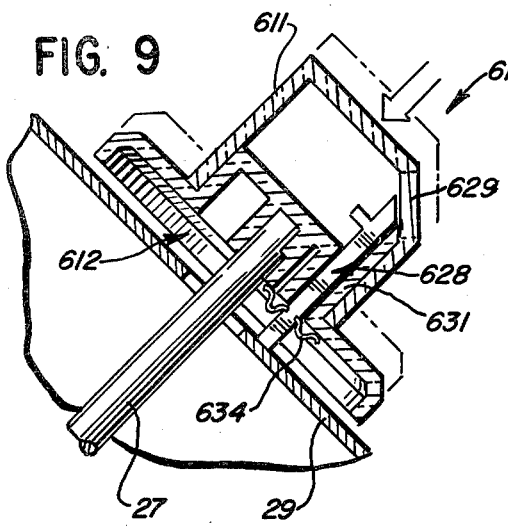
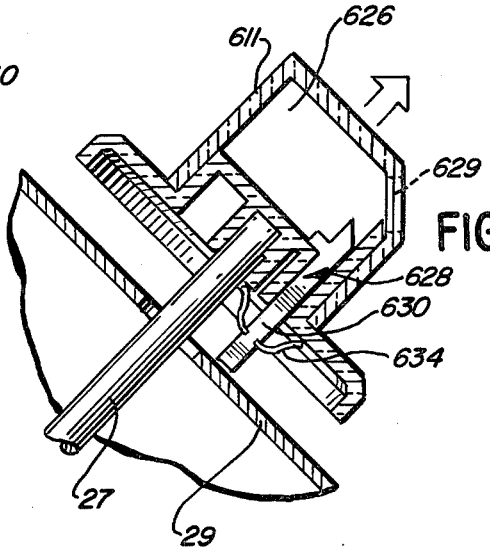
FIG. 10
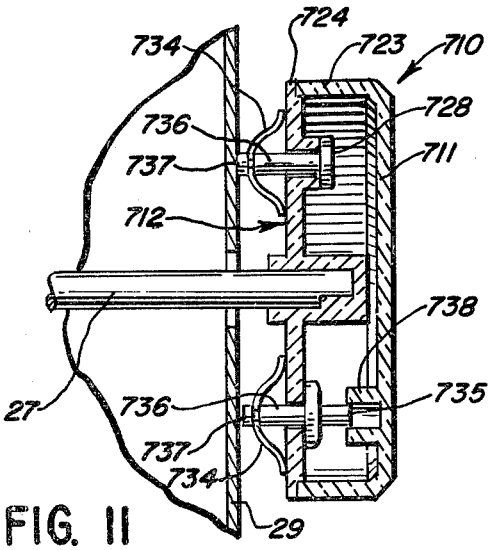
FIG. 11
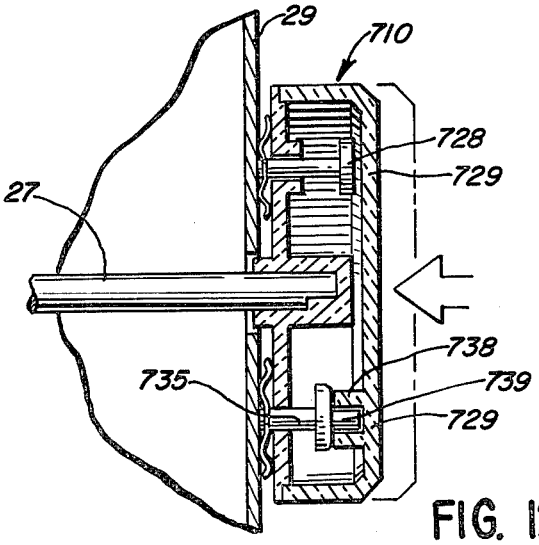
FIG. 12

MANIPULATING ROTARY CONTROL DEVICE

TECHNICAL FIELD

This invention relates to rotary control devices and in particular to knobs for use in controlling rotatable and axially movable shafts.

BACKGROUND ART

It is conventional in controlling rotary shafts, such as the shaft of ranges and the like, to provide a control knob adapted to be secured to the projecting end of the control shaft forwardly of the outer wall of the range. Such control knobs utilize hub details which make the control knobs relatively expensive.

Such knobs are conventionally associated with dials for indicating to the user the disposition of the rotary shaft. It is necessary to maintain a relatively low temperature of the knob to permit the user to manipulate the shaft without injury. In one conventional range structure, the control shaft projects forwardly through a small opening in the range wall. The shaft is rotatable and axially movable. Conventionally, the shaft must be urged axially inwardly before rotation of the shaft may be effected, thereby to prevent inadvertent rotation of the shaft.

DISCLOSURE OF THE INVENTION

The present invention comprehends an improved manipulating rotary control device having a hollow knob attached to a base means defining a dial. The base means may further define a socket for receiving the end of the control shaft. The socket may be defined by a hub portion of the base means.

The knob may be connected to the base means so as to effect desired rotation of the control shaft as a result of rotation of the knob. Further, the knob may be formed of a transparent material permitting the interior of the knob to be suitably decorated as by painting, electroplating, etc.

A portion of the knob may be light-transmissive so as to permit selective disposition of an indicator within the knob to indicate the disposition of the control shaft.

The indicator may be movably carried by the base means and in the illustrated embodiment, engages the wall from which the shaft projects so as to permit selective positioning of the indicator within the knob as a result of selective movement of the knob toward and from the wall.

The base means may define a dial projecting outwardly from the knob and a hub portion may be provided unitarily with the dial or as a separate element connected thereto as desired.

In one embodiment, the control knob is congruent with the outer periphery of the dial.

In one embodiment, the indicator means is biased by suitable spring means into engagement with the wall adjacent the control shaft.

In one embodiment, the indicator means is provided with suitable seals for sealing the interior of the hollow knobs notwithstanding the projection of the indicator means from the knob space.

The indicator means may be slidably carried on the base means, and in one embodiment, the knob includes a portion slidably engaged by the indicator means.

The control device of the present invention is extremely simple and economical of construction while yet providing a highly improved control means as discussed above.

BRIEF DESCRIPTION OF THE DRAWING

Other features and advantages of the invention will be apparent from the following description taken in connection with the accompanying drawing wherein:

FIG. 1 is a perspective view of a control device embodying the invention;

FIG. 2 is a diametric vertical section thereof;

FIG. 3 is a vertical diametric section of a modified form of control device embodying the invention;

FIG. 3a is a fragmentary section taken substantially along the line *3a—3a* of FIG. 3;

FIG. 4 is a vertical diametric section illustrating a further modified form of control device embodying the invention;

FIG. 5 is a diametric section illustrating still another form of control device embodying the invention;

FIG. 6 is a diametric section illustrating yet another form of control device embodying the invention;

FIG. 7 is a diametric section illustrating yet another form of control device embodying the invention, having an indicator selectively disposable within the control knob;

FIG. 8 is a fragmentary view generally similar to that of FIG. 7 illustrating an "off" arrangement of the control device of FIG. 7;

FIG. 9 is a diametric section of yet another form of control device embodying the invention, having a modified form of indicator;

FIG. 10 is a view generally similar to that of FIG. 9 showing the control device of FIG. 9 in an "off" position;

FIG. 11 is a diametric section illustrating yet another form of control device embodying the invention, having yet another form of indicator; and FIG. 12 is a diametric section of the device of FIG. 11 shown in an "on" position.

BEST MODE FOR CARRYING OUT THE INVENTION

AS indicated briefly above, the invention comprehends the utilization of a hollow, molded synthetic resin knob in a control device providing a number of substantial improvements in the art. A number of different embodiments of the invention are shown in the drawing providing a range of features in combination with the hollow knob construction.

More specifically, as seen in FIGS. 1 and 2, a manipulating rotary control device generally designated 10 is shown to include a hollow knob 11 formed of a thermally insulating material, such as molded synthetic resin. The control device further includes a base means generally designated 12. As shown in FIG. 2, the base means may include a dial portion 13 and a hub portion 14. In the embodiment of FIG. 2, the hub portion 14 is secured to the dial portion by suitable interlocking lugs 15 extending through suitable openings 16 in the dial portion 13. The hub defines a shaft socket 17 for receiving the end of the rotary control shaft, such as the shaft of a domestic range control.

The knob 11 may be secured to hub portion 14 by connection thereof to the dial 13, as shown in FIG. 2. More specifically as shown therein, the knob includes a connecting portion 18 heat staked to the dial which, illustratively, may be formed of metal. A number of connecting portions 18 may be provided extending through suitable openings 19 in the dial, as shown in FIG. 2.

The control knob defines a hollow recess 20 which receives the outwardly projexting portion 21 of the hub. As indicated above, the control knob may be formed of a transparent plastic material, permitting the inner surface thereof to be suitable decorated as by vacuum plating, painting, or other decorative treatment so as to provide a wide range of easthetic effects in the control knob. As the control knob may be formed of a thermally insulating material, the dial may be formed as a low cost metal dial as well as of insulating material.

The hub may comprise a molded synthetic resin element providing further thermal insulation between the control shaft and the manipulating knob. Thus, the hub portion 14 may be secured to the dial by heat staking of the lugs 15 to the dial.

Socket 17 may define a suitable shoulder 22 for limiting the insertion of the control shaft into the socket and for controlling the axial displacement of the shaft in the normal manner.

Referring now to the embodiment of FIG. 3, a modified form of control device generally designated 110 is shown to comprise a control device similar to control device 10 but wherein the hub portion 114 is secured to the knob 111 rather than to the dial 113. More specifically, as shown in FIG. 3, the hub portion may include a connecting portion 115 sonically welded to the connecting portion 118 of the knob. The knob may be connected to the dial 113 as by heat staking similar to the connection of the knob 11 to the dial 13 in the control device 10. As shown in FIG. 3*a*. the connecting portion 115 may be serrated and fitted into correspondingly serrated connecting portion 118 of the knob so as to provide a positive rotationally fixed association of the knob with the hub.

Referring now to the embodiment of FIG. 4, a further modified form of control device generally designated 210 is shown to comprise a control device similar to control device 10 but wherein the base means 112 comprises a unitary element defining both the dial portion 213 and hub portion 214 thereof. As shown in FIG. 4, the knob 211 may be connected to the base means 112 at the juncture of the dial portion 213 with the hub portion 214.

In FIG. 5, a still further modified form of control device generally designated 310 is shown to comprise a control device generally similar to control device 210 but wherein the knob 311 includes an annular flange 323 engaging a shoulder 324 on the dial portion 313 and sonically welded thereto to provide the desired connection of the knob to the dial. Illustratively, the base means 312 may define a unitary element including both the dial 313 and hub portion 314, as desired.

In FIG. 6, still another control device 410 is shown to comprise a hollow knob 411 defining a peripheral flange 423 congruent with the periphery 424 of the dial portion 413 of the base means. The flange may be heat staked to the peripheral portion 424, as shown in FIG. 6.

The socket 417 may be closed at the inner end by a transverse wall 425 to seal the interior space 426 within the knob 411. Such a transverse closure wall may be utilized with any of the socket and hub constructions of the different embodiments and is further exemplified in the control devices 210 and 310. As will be obvious to those skilled in the art, such a closure wall may be utilized in the devices 10 and 110, or may be omitted in any of the devices 210, 310 and 410 within the broad scope of the invention.

The different embodiments of FIGS. 1–6 are exemplary only. The inventive concept of the use of a hollow manipulating knob permitting facilitated decoration of the interior surface thereof may be utilized into each of the different embodiments. By utilizing a thermally insulating material for the control knob, an improved, low cost device manufacture is provided. As indicated, the manufacture may comprise alternatively a two-piece construction or a three-piece construction, as desired.

Referring now to FIGS. 7–12, an exemplary control shaft 27 is shown extending outwardly through an opening 28 in a wall 29. As indicated briefly above, one embodiment of such a structure is that of a domestic range wherein the shaft 27 comprises the axially positionable and rotatable control shaft of the burner control with the wall 29 comprising a portion of the cabinet of the range. In the embodiment of FIGS. 7 and 8, a further modified form of control device generally designated 510 is shown to comprise a control device generally similar to control device 10 but having associated therewith and indicator generally designated 528. The knob 511 may include a transparent portion 529 through which may be viewed, when juxtaposed thereto, an indicating portion 540 of the indicator 528. The indicating portion is carried on suitable carrier portions 530 slidably received in a guide portion 531 of the base means 512 so as to have an inner end 532 of the carrier portions abut the wall 29 adjacent the shaft 27.

Each of the carrier portions may include a collar 533. A coil spring 534 may be compressed between the collar 533 and hub portion 514 of the base means so as to effectively maintain the indicator portion 540 in an innermost disposition within the hollow knob 511.

Thus, as shown in FIG. 8, when the control knob 511 is spaced outwardly from the wall 29, as when the control shaft is in the "off" disposition, indicator 528 is spaced or disaligned with the transparent portion 529 of the control knob so that no indication is made at that time. However, when the control knob is brought inwardly to the "on" disposition of FIG. 7, the indicator 528 is observable through the transparent window 529. In the illustrated embodiment, the indicator comprises a red indicator for indicating the "on" condition of the range heater.

Thus, the control knob and dial may have free movement toward and from the wall 29 while the indicator 528 is effectively maintained for selective observation through the knob 511. As in the embodiment of FIGS. 1–6, the control knob 511 is hollow and may be suitably connected to the base means 512 as desired.

Referring now to the embodiment of FIGS. 9 and 10, still a further modified form of control device generally designated 610 is shown to comprise a control device generally similar to control device 510, but wherein the wall 29 is inclined to the horizontal. The control knob window 629 defines a corner of the control knob 611. The indicator 628 is slidably received in a guide portion 631 of the base means 612 to be selectively juxtaposed to the window 629 and spaced therefrom, as shown respectively in FIGS. 9 and 10, as a function of the disposition of the control knob relative to the wall 29. The carrier portion 630 of the indicator 628 is biased toward wall 29 by an annular spring element 634 which further serves as a seal for preventing entrance of moisture, etc., into the space 626 within the knob 611. As shown in FIG. 9, the spring 634 biases the indicator 628 into engagement with the wall 29.

Referring now to the embodiment of FIGS. 11 and 12, a barrel-type control device generally designated 710 is shown to comprise a barrel knob 711 similar to knob 411 and including a flange 723 secured to the peripheral portion 724 of the base means 712 of the device 710. Device 710 includes a pair of indicators 728 and 735, each having a carrier portion 736 extending slidably through the base means 712 and defining inner ends 737 engaging the wall 29. The indicators may be biased to engage the wall by suitable sealing springs 734.

Indicator 735 may be guided by a suitable guide portion 738 on the knob 711, as shown in FIGS. 11 and 12. Thus, when the control device 710 is moved inwardly toward the wall 29, as shown in FIG. 12, indicators 728 and 735 are juxtaposed to transparent portions 729 of the knob to indicate the "on" condition of the device. As shown, the guide 738 may comprise an annular guide receiving a cylindrical end portion 739 of the indicator 735.

If desired, the indicators may comprise electrically operated lamps or the like brought out through a hollow shaft to provide further positive indication of the "on" condition of the device being controlled.

As shown in the embodiments of FIGS. 7–12, the shaft sockets may be closed at their inner ends so as to maintain the space within the hollow knob effectively sealed.

By eliminating the necessity for providing an intricate hub and socket structure integral with the knob, an improved low cost manufacture is obtained. The use of the hollow knob permits facilitated indicated operation when desired by permitting selective portions of the knob to be transparent. Further, the use of the hollow knob permits facilitated decoration or coloring of the knob by suitable application of material to the inner surface. The use of the decorative material on the inner surface effectively prevents wear thereon and permits the use of metalizing and other similar relatively fragile but highly decorative surface coatings at low cost.

Alternatively, the interior surface of the knob may be provided with suitable indications for cooperation with the movable indicator means to provide further improved safety functioning. The hollow knob effectively defines a hollow, protective shell for the control device which is extremely simple and economical of construction while yet providing an improved protection for the shaft connection to the hub and permitting the use of a metal dial while yet assuring a low temperature condition of the manipulating portion of the device.

The foregoing disclosure of specific embodiments is illustrative of the broad inventive concepts comprehended by the invention.

I claim:

1. A manipulating rotary control device comprising:
a dial having a peripheral portion;
a hub located inwardly of said dial peripheral portion and defining a socket arranged for selective removable coaxial mounting thereof onto a control shaft end, said dial and hub being arranged to provide access to said socket from one facial side of said dial;
a hollow manipulating knob formed of a thermal insulation, light transmitting material and having a connecting portion connected to said dial for effecting rotation of said dial as a result of manual rotation of said knob about the axis of rotation of said socket, the inner surface of the knob being provided with a reflective coating; and
means for interconnecting said knob and said hub for rotating about said socket about the axis thereof as an incident of said manual rotation of said knob, said knob including a portion covering said hub at the opposite facial side of the dial.

2. The manipulating rotary control device of claim 1 wherein said knob is formed of synthetic resin.

3. The manipulating rotary control device of claim 1 wherein said hub projects into said knob.

4. The manipulating rotary control device of claim 1 wherein said inner surface of said knob is provided with a reflective metal coating.

5. The manipulating rotary control device of claim 1 wherein said hub and dial comprise a one-piece unit.

6. The manipulating rotary control device of claim 1 wherein said dial is formed of metal.

7. The manipulating rotary control device of claim 1 wherein said hub and dial comprise a one-piece unit formed of molded synthetic resin.

8. The manipulating rotary control device of claim 1 wherein said hub defines a closure extending across said socket for preventing ingress of moisture from said opposite facial side of the dial.

9. The manipulating rotary control device of claim 1 wherein said hub is provided with a portion extending outwardly relative to the socket.

10. The manipulating rotary control device of claim 1 wherein said hub and dial comprise a one-piece unit and the periphery of said dial is substantially congruent with said knob portion.

11. A manipulating rotary control device comprising:
a dial having a peripheral portion;
a hub located inwardly of said dial peripheral portion and defining a socket arranged for selective removable coaxial mounting thereof onto a control shaft end, said dial and hub being arranged to provide access to said socket from one facial side of said dial;
a manipulating knob formed of a thermal insulation material and having a connecting portion connected to said dial for effecting rotation of said dial as a result of manual rotation of said knob about the axis of rotation of said socket; and
means for interconnecting said knob and said hub for rotating said socket about the axis thereof as an incident of said manual rotation of said knob, said knob including a portion covering said hub at the opposite facial side of the dial, said knob being formed of synthetic resin and being heat staked to said dial to form the connection therebetween.

12. A manipulating rotary control device comprising:
a dial having a peripheral portion;
a hub located inwardly of said dial peripheral portion and defining a socket arranged for selective removable coaxial mounting thereof onto a control shaft end, said dial and hub being arranged to provide access to said socket from one facial side of said dial;
a manipulating knob formed of a thermal insulation material and having a connecting portion connected to said dial for effecting rotation of said dial as a result of manual rotation of said knob about the axis of rotation of said socket; and
means for interconnecting said knob and said hub for rotating said socket about the axis thereof as an incident of said manual rotation of said knob, said knob including a portion covering said hub at the opposite facial side of the dial, said hub being welded to said dial to form the connection therebetween.

13. The manipulating rotary control device of claim 12 wherein said hub is sonically welded to said dial.

14. For use with a rotatable and axially displaceable control shaft end projecting from a wall, an improved indicating control knob assembly comprising:

base means defining a securing portion arranged to be fixed to said shaft end, and a dial extending outwardly from said securing portion;

a hollow knob having a light-transmitting outer portion and means connecting the knob to the base means for effecting selective movement of the control shaft; and indicator means movably carried by the base means for selective disposition within said knob for viewing thereof through said knob light-transmitting portion as an incident of axial displacement of said shaft by said knob to a disposition wherein the dial is disposed in an inner disposition adjacent said wall.

15. The control knob structure of claim 14 wherein means are provided for maintaining said indicator means fixed notwithstanding movement of said base means toward and from said wall.

16. The control knob structure of claim 14 wherein said indicator means includes a carrier portion and means biasing said carrier portion into engagement with said wall.

17. The control knob structure of claim 14 wherein said indicator means includes a carrier portion slidably carried by said base means and means biasing said carrier portion into engagement with said wall.

18. The control knob structure of claim 14 wherein said indicator means includes a carrier portion slidably carried by said base means and means biasing said carrier portion into engagement with said wall, said indicator means further including a portion slidably engaging said knob.

19. The control knob structure of claim 14 further including means for sealing said indicator means to said base means.

20. The control knob structure of claim 14 wherein said indicator means includes a carrier portion and means biasing said carrier portion into engagement with said wall, and means for sealing said carrier portion to said base means.

21. The control knob structure of claim 14 wherein said knob is peripherally congruent with said dial.

* * * * *